United States Patent [19]

Lewis et al.

[11] Patent Number: 4,587,775

[45] Date of Patent: May 13, 1986

[54] RETRACTABLE CLOSURE FOR ROOF OPENING

[75] Inventors: Roger E. Lewis; Webb W. Hayes, Jr., both of Orinda, Calif.

[73] Assignee: Earl & Wright, San Francisco, Calif.

[21] Appl. No.: 631,872

[22] Filed: Jul. 18, 1984

[51] Int. Cl.[4] ..... E04B 7/16

[52] U.S. Cl. ..... 52/65; 52/66

[58] Field of Search ..... 49/39, 40; 52/6, 64, 52/65, 69, 66, 83, 80, 81, 7

[56] References Cited

U.S. PATENT DOCUMENTS

| | | | |
|---|---|---|---|
| 1,841,321 | 1/1932 | Arnstein | 52/65 |
| 1,921,652 | 8/1933 | Bohnert | 49/40 |
| 3,149,703 | 9/1964 | DeFelice . | |
| 3,195,275 | 7/1965 | Praeger | 52/83 |
| 3,510,996 | 5/1970 | Popil . | |
| 4,075,795 | 2/1978 | Thomas | 52/80 |
| 4,204,372 | 5/1980 | Agopyan . | |
| 4,312,157 | 1/1982 | Hertel . | |

FOREIGN PATENT DOCUMENTS

| | | | |
|---|---|---|---|
| 235666 | 4/1910 | Fed. Rep. of Germany | 52/64 |
| 1529744 | 6/1968 | France | 52/65 |

OTHER PUBLICATIONS

Modern Plastics, Mar. 1952, pp. 102 & 103.

*Primary Examiner*—John E. Murtagh

*Attorney, Agent, or Firm*—Flehr, Hohbach, Test, Albritton & Herbert

[57] ABSTRACT

A building structure having a roof opening which is covered by a retractable closure. The retractable closure includes a plurality of panels which are pivotally mounted about the margin of the roof opening. The panels are sized and shaped so that they fit together and cover the opening when in their closed positions, and when the panels are in their open positions the roof opening is completely unobstructed. Tracks on the roof support the panels and resist vertical load forces. Support towers and guy lines are provided to bear a part of the load forces as the panels are closed. Drive means is provided for opening and closing the panels conjointly or independently to achieve a range of roof opening capability.

9 Claims, 3 Drawing Figures

RETRACTABLE CLOSURE FOR ROOF OPENING

This invention relates to buildings and other large structures having roof openings and in particular relates to retractable closures for the roof openings.

Various building designs such as domed stadiums and pavilions have been designed with roof openings for admitting light and air. In order to close off the roof opening, such as during inclement weather conditions, different types of covers or closures have been provided. Among these prior designs are those in which guide rails are constructed over or along the openings for supporting roof elements which slide or roll along the rails across the opening. Another type of prior roof closure is that in which hinged arches pivot in the manner of an accordion over the opening. Another prior art closure design employs strips of fabric which are pulled in side-by-side relationship across the opening. In certain types of greenhouse structures a plurality of roof sections are pivotally mounted so that they can be pivoted up and down to open and close the roof.

The limitations and drawbacks of the prior roof closure designs include the difficulty of supporting the roof sections or coverings across openings of large dimensions such as in stadiums where the roof opening typically is hundreds of feet in diameter. In a number of the prior deisgns structural members such as support rails, cables and the like extend across the opening so that the aesthetic and other advantages of an unobstructed opening are lost. In many cases the prior closure designs would be infeasible when scaled up for use in covering large openings such as for stadia. Certain of the prior designs are also relatively complicated in design and would be expensive to construct and maintain.

Accordingly, it is an object of the present invention to provide a new and improved retractable closure for a roof opening which obviates many of the disadvantages and limitations of prior closure designs.

Another object is to provide a retractable closure for a roof opening in which a plurality of roof panels are mounted about the margin of the roof opening with means for pivoting the panels across the opening. The panels are sized and shaped so that when closed the panels fit together to cover the opening, and when moved to open position the roof opening is completely unobstructed.

Another object is to provide a retractable closure of the type described in which the roof panels can be opened and closed either conjointly or independently for controlling the area of the roof opening which is exposed.

Another object is to provide a retractable roof closure of the type described in which the roof panels are vertically supported when in closed position so that the panels can close to cover a roof opening of relatively large dimensions and can also open leaving the roof opening completely unobstructed.

Another object is to provide a retractable closure of the type described which is relatively simple in design and less complicated and expensive to construct and maintain.

The invention in summary includes a plurality of roof panels which form a retractable closure for a roof opening. The panels are mounted about the margin of the roof opening and are adapted for pivoting across the opening. The panels are sized and shaped so that when pivoted across the opening they interfit to cover the opening. When the panels are pivoted to open position the roof opening is unobstructed. The panels can be moved conjointly or they can also be moved independently for partial closure of the opening.

The foregoing and additional objects and features of the invention will appear from the following specification in which the preferred embodiment has been described in conjunction with the accompanying drawings.

Figure 1:
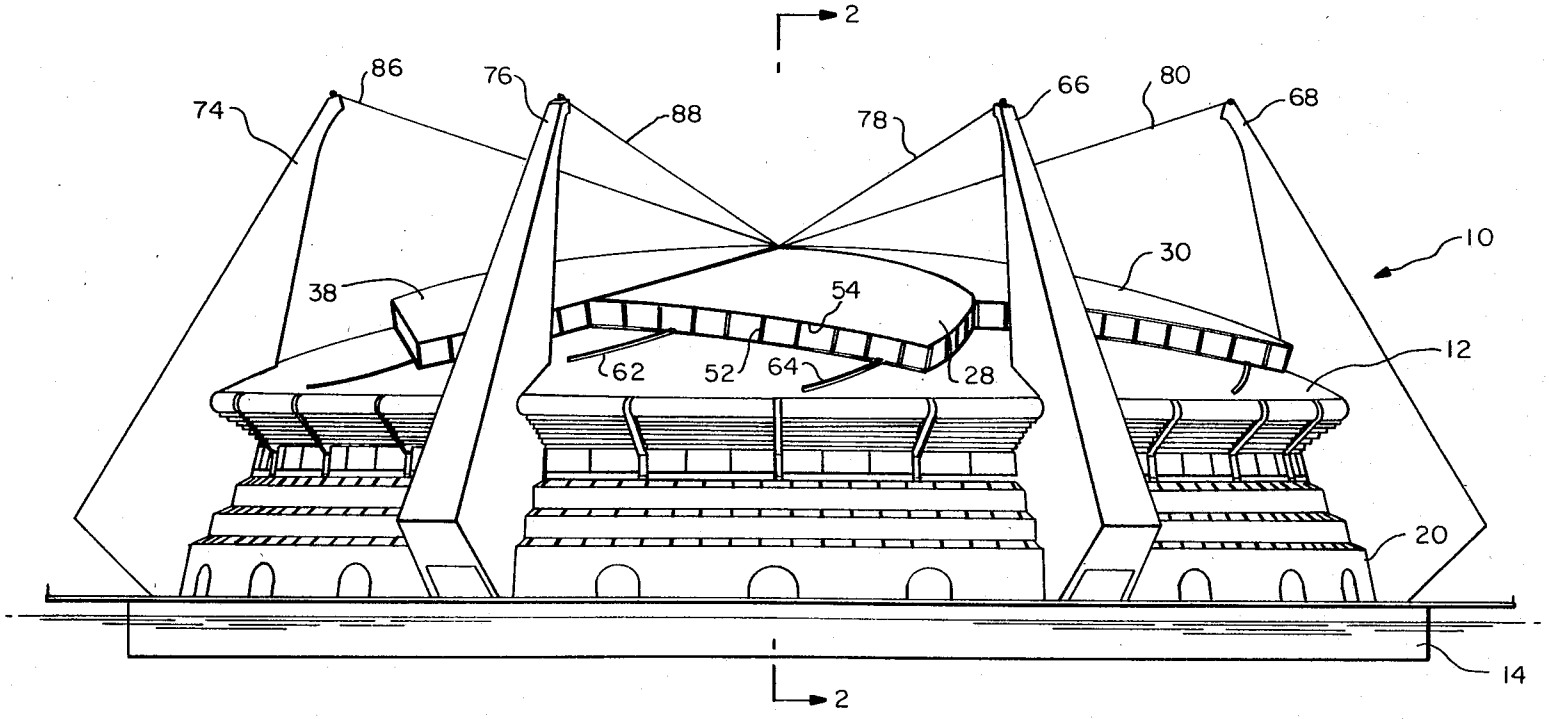
FIG. 1 is a front elevation view of a building structure incorporating the retractable closure of the invention.

In the drawings the preferred embodiment of the invention is incorporated in a building structure comprising a floating stadium 10 having a spherical domed roof 12. it is understood that the invention has application for use in diverse building structures such as pavilions and other buildings, constructed on land or water, having roof openings to be covered.

Domed stadium 10 includes a barge or vessel 14 which provides flotation for the structure so that the stadium can be berthed at an area near a large metropolitan center for utilization as a sports center, concert hall and the like. The barge is circular in plan view, although other configurations could be utilized.

Figure 2:
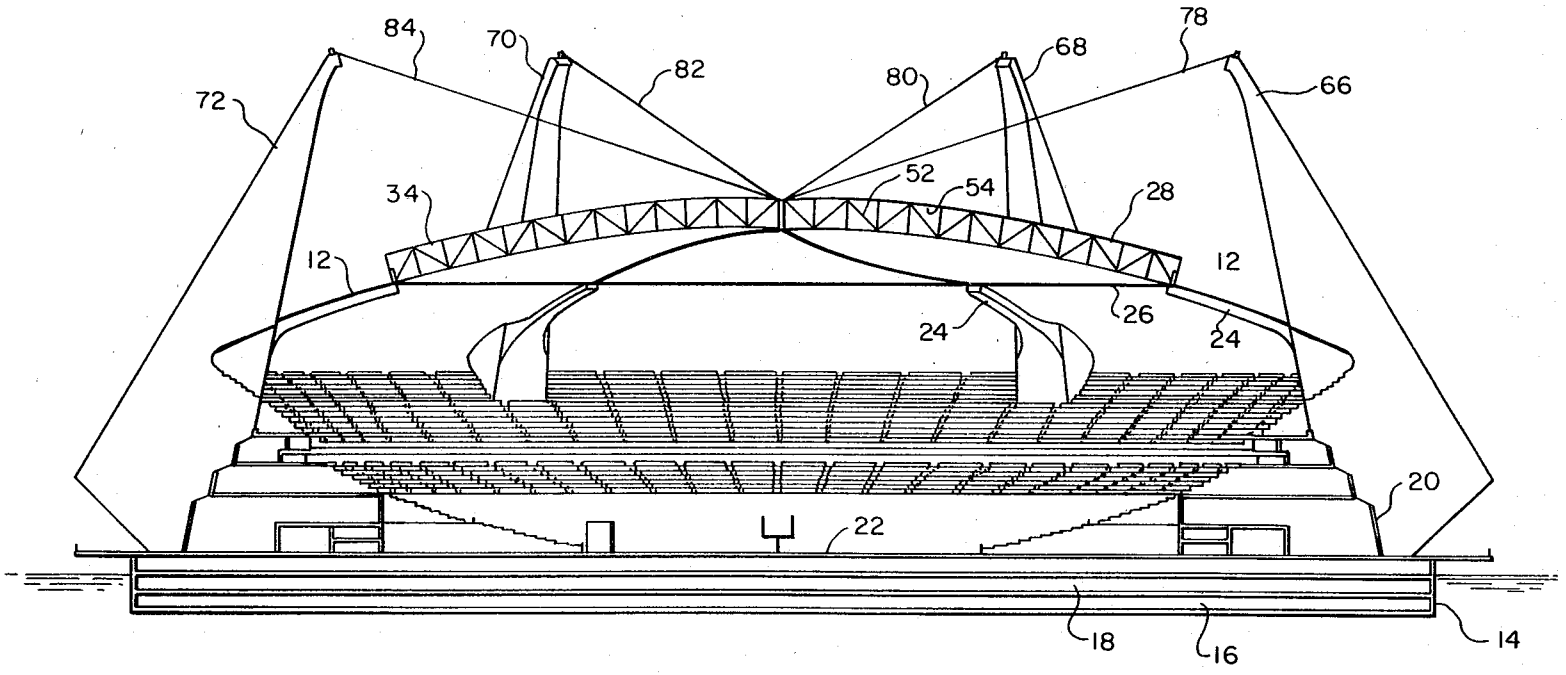
FIG. 2 is a cross-section of the building structure taken along the line 2—2 of FIG. 1.

As best shown in FIG. 2 the barge 14 has multiple levels 16, 18 and supports about its perimeter the stadium walls 20 with the playing field 22 centrally located. The building walls support the domed roof 12 by means of flying buttresses 24. The domed portion of the roof extends to the edge of a central opening 26, which is shown in this embodiment as circular. Depending upon the particular design specifications and aesthetics, the roof opening could be shaped in other geometric configurations such as a polygon or a free-form curve.

The invention has application for use with building structures having roof openings of large dimensions. As an example for the domed stadium shown in FIGS. 1–3, the spherical radius of the dome would be on the order of 920 feet and the clearance of the dome above the playing field would be 250 feet. In this case the maximum diameter of the roof opening would be 500 feet.

The retractable closure of the invention comprises a plurality of roof panels 28–38. The preferred embodiment provides six generally triangular shaped panels which are pivotally mounted at respective pivot joints 40–50 about the margin of roof opening 26. The pivot joints could also be positioned at other locations on the roof outside the roof opening. The pivot joints are located at 60° intervals about the opening. The invention also contemplates a roof closure with a plurality of panels greater than six or less than six with the shapes of the individual panels modified conformingly. For example, in the case where there are more than six panels the panels would be shaped so as to overlap when closed.

The roof panels preferably are formed of lightweight steel truss framing 52 as shown in FIGS. 1 and 2. The panel covering comprises thin gauge metal or other suitable skin 54 placed across the framing. The panels are shaped to generally conform with the shape of the roof. In the case where the roof is a section of a spherical shell, the individual panels would similarly be sections of a spherical shell of substantially the same spherical radius. In the case where the roof is flat the individual panels would also be substantially flat.

Each of the individual panels are formed with an outer edge 56 and a circular inner edge 58 which diverge from an apex at which the pivot connection to the roof is located. The inner edge is shaped commensurate with the shape of the roof opening so that when fully opened the panel inner edges align with the roof opening. This permits the roof opening to be completely unobstructed when the panels are open. In the preferred embodiment of FIG. 3 the panel inner edges are circular and have a radius substantially equal to the radius of roof opening 26.

Figure 3:
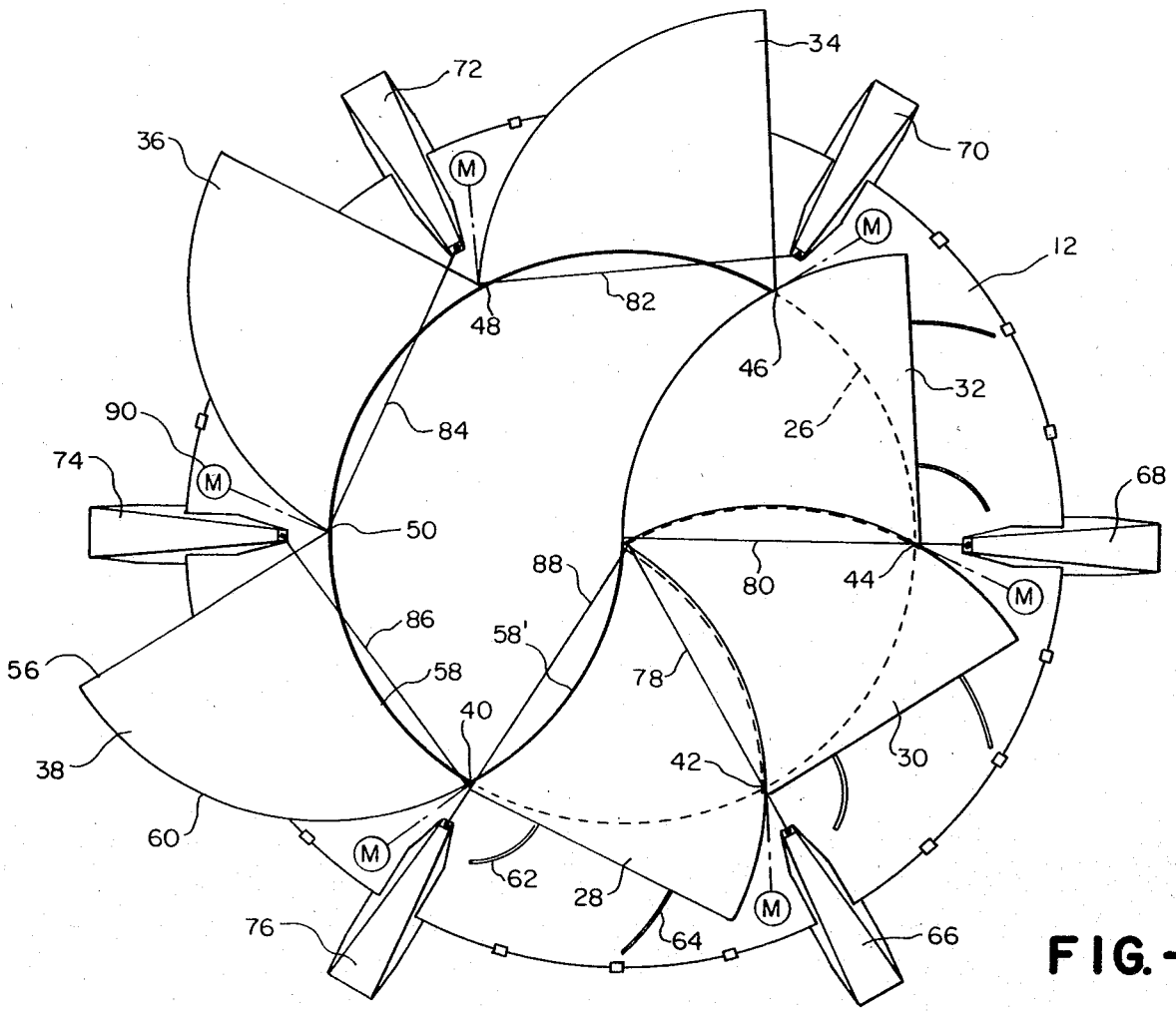
FIG. 3 is a top plan view of the building structure of FIG. 1.

The medial edges 60 of each of the panels are also shaped commensurate with the inner edges. In the embodiment of FIG. 3 the circular medial edges permit independent pivoting of the individual panels without interference from adjacent panels. For example, panel 38 can be moved between its open and closed positions while adjacent panel 28 remains closed with medial edge 60 moving in close-spaced relationship along the inner edge 58' of the adjacent panel. When any two adjacent panels are closed the inner and outer edges closely face each other along a circular interface. This interface can be covered from the weather by suitable sealing means, not shown, such as a tongue and groove interfit between the edges.

Support means is provided for supporting the panels in their opened and closed positions and during movement across the roof opening. The support means includes a plurality of tracks 62, 64 between the domed roof and panels. The tracks are generally circular and have radii centered at the pivot point of each panel they support. Preferably at least two tracks are provided for each panel. In the illustrated embodiment the tracks comprise rails mounted on the upper margin of the roof. Suitable guide wheels or shoes, not shown, mounted on the lower surfaces of the panels interfit with the tracks to support vertical load forces. When the panels are fully or partially closed with the inner edges cantilevered out over the roof opening the tracks resist upwardly directed loads on the outer portion of the panels. Similarly, when the panels are moved outwardly toward their open positions the tracks resist downwardly directed load forces.

In the illustrated embodiment the panel support means also includes a plurality of support towers 66–76 extending above the roof, with one tower provided for each of the panels. A plurality of guy lines 78–88 are provided with each line attached at its upper end to one of the towers and at its lower end to a respective panel at the apex between its inner and medial edges. The upper end of each guy line is attached to its respective tower at a point which lies on a line extending from the center of the sphere through the pivot axis for that panel. This permits the guy line to move without shortening or lengthening as the panel pivots throughout its opening and closing movement. In the case where the roof is horizontally flat the point of connection of the guy line to the tower would be on a vertical line extending through the pivot point of the respective panel. As each panel is moved across the opening toward its closed position the guy line bears a component of the vertical loads imposed on the overhanging portion of the panels. Depending upon the particular design specification and requirements, this vertical loading when the panels are moved toward their closed positions could be resisted entirely by the track means without the requirement of the support towers and guy lines.

In the preferred embodiment having a domed roof of spherical shape the force of gravity acts to move the panels from the closed position downwardly along the tracks toward the open position. Suitable drive means 90 is provided to assist movement of the panels. The drive means can comprise a rack and pinion drive connected to the panels and powered by a suitable electric or hydraulic motor. Another drive means that could be employed is a winch and cable drive for each panel. The motor and drive arrangement are reversible for moving the panels upwardly along the tracks toward their closed positions and downwardly toward the open position. The motors are controlled to operate conjointly or independently, as desired, for moving the panels conjointly so that they open and close together, or independently and in any combination to achieve partial opening. For example, any combination of one or more of the panels can be operated to partially or fully open and thereby expose a progressively greater area of the roof opening. The panel drives can also be operated in the conjoint mode so that each of the panels is partially opened in the manner of the partial opening of a lens shutter. The various combinations of panel openings that are available not only provide a range of exposure for the roof opening but also achieves a variation in aesthetic appearance during partial roof opening.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A retractable closure for an opening in the roof of a building structure, including a plurality of roof panels positioned on the roof outside the roof opening, means for mounting the panels on the roof at respective upright pivot axes for pivotal movement across the opening between opened and closed positions, said pivot axes being spaced at intervals about the periphery of the roof opening, with each of the panels being sized and shaped to extend across a portion of the opening when the panels are in the closed position and with the roof opening substantially unobstructed when the panels are in the open position, means for pivoting the panels across the opening, and means for vertically supporting the panels when they are over the opening.

2. A retractable closure as in claim 1 in which each of the panels is formed with inner and outer edges extending from a pivot axis of the panel and a medial edge extending across the panel between the inner and outer edges, the inner edge of each panel being shaped commensurate with the shape of the roof opening so that when all panels are moved to their open positions the opening is substantially unobstructed.

3. A retractable closure as in claim 2 in which the medial edge of each panel is shaped commensurate with the inner edge of an adjacent panel whereby the medial and inner edges of adjacent panels interfit when the panels are closed.

4. A retractable closure as in claim 3 in which the medial edge of each panel is a segment of a circle with a radius at the pivot axis of the respective panel whereby the panels can be opened and closed conjointly or independently of one another.

5. A retractable closure as in claim 1 in which the means for mounting the panels includes means forming tracks on the roof beneath the panels for guiding and supporting the portion of the panels moving across the roof as the panels are opened and closed.

6. A retractable closure as in claim 1 in which six roof panels are mounted on the roof at pivot axes which are positioned at sixty degree intervals around the opening.

7. A retractable closure as in claim 1 in which the means for vertically supporting the panels includes support tower means extending above the roof, and a plurality of guy lines attached at their upper ends to the support tower means, with each guy line attached at its lower end to a respective panel at a portion which extends over the opening when the panel is closed.

8. A retractable closure as in claim 1 in which the upper portion of the roof has a spherical domed shape, and the pivot axes of the panels extend through the center of the sphere.

9. A retractable closure as in claim 8 in which the means for vertically supporting the panels includes support tower means extending above the roof and a guy line for each panel with the upper end of each guy line attached to the support tower means at a point which lies along a line extending from the center of the sphere through the pivot axis for the respective panel, and the lower end of each guy line is attached to a portion of the respective panel which extends over the opening when the panel is closed.

* * * * *